United States Patent [19]

Franklin

[11] 4,040,669

[45] Aug. 9, 1977

[54] SELF PROPELLED EXCAVATING VEHICLE

[76] Inventor: Wesley D. Franklin, 1005 D. Pleasant Oaks Road, Baltimore, Md. 21234

[21] Appl. No.: 639,737

[22] Filed: Dec. 11, 1975

[51] Int. Cl.[2] ..... E21D 9/10

[52] U.S. Cl. ..... 299/56; 299/22; 299/67

[58] Field of Search ..... 299/31, 33, 56, 57, 299/58, 62, 64, 67, 86; 175/61, 62, 219; 173/24, 52

[56] References Cited

U.S. PATENT DOCUMENTS

| | | | |
|---|---|---|---|
| 1,462,997 | 7/1923 | Anderson | 299/56 |
| 1,570,829 | 1/1926 | Forsyth | 299/67 |
| 2,083,834 | 6/1937 | Galuppo et al. | 299/56 |
| 2,942,863 | 6/1960 | Joy | 299/56 |
| 3,297,101 | 1/1967 | Wohlmeyer | 299/62 X |

FOREIGN PATENT DOCUMENTS

| | | | |
|---|---|---|---|
| 82,656 | 6/1921 | Austria | 299/62 |
| 40,156 | 5/1929 | Denmark | 299/15 |
| 593,260 | 3/1959 | Italy | 173/24 |

*Primary Examiner*—Ernest R. Purser
*Attorney, Agent, or Firm*—William G. Gapcynski; Lawrence A. Neureither; Frank R. Agovino

[57] ABSTRACT

A vehicle which can easily be dismantled into transportable units and reassembled readily at the tunnel site is provided. A major advantage of this vehicle is the requirement of low thrust during operation and adaptability to use in short tunnels and tunnels with variable rock formations. With only minor adjustments to the drill head assembly and crawler carriage, it is capable of conforming to variable diameters of tunnel sizes. Pneumatic drills in the drill head assembly are guided along the vehicle's path to cut kerfs into the rock. Fluid activated breaker elements enter the kerfs and break out the ridges of rock through smashing blows. The drill head assembly rotates as the kerf cutting process is repeated. The excavated rock is conveyed to the rear of the vehicle for easy disposal. The drills are capable of boring any type of rock, therefore, it is envisioned that this vehicle can excavate soft through very hard formations.

9 Claims, 12 Drawing Figures

FIG. 6
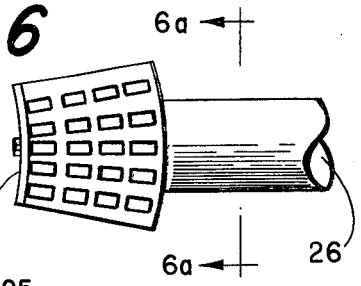
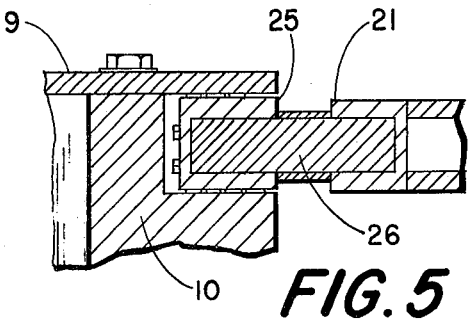
FIG. 5
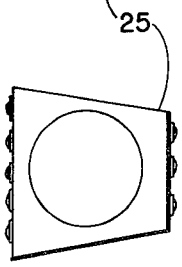
FIG. 6a
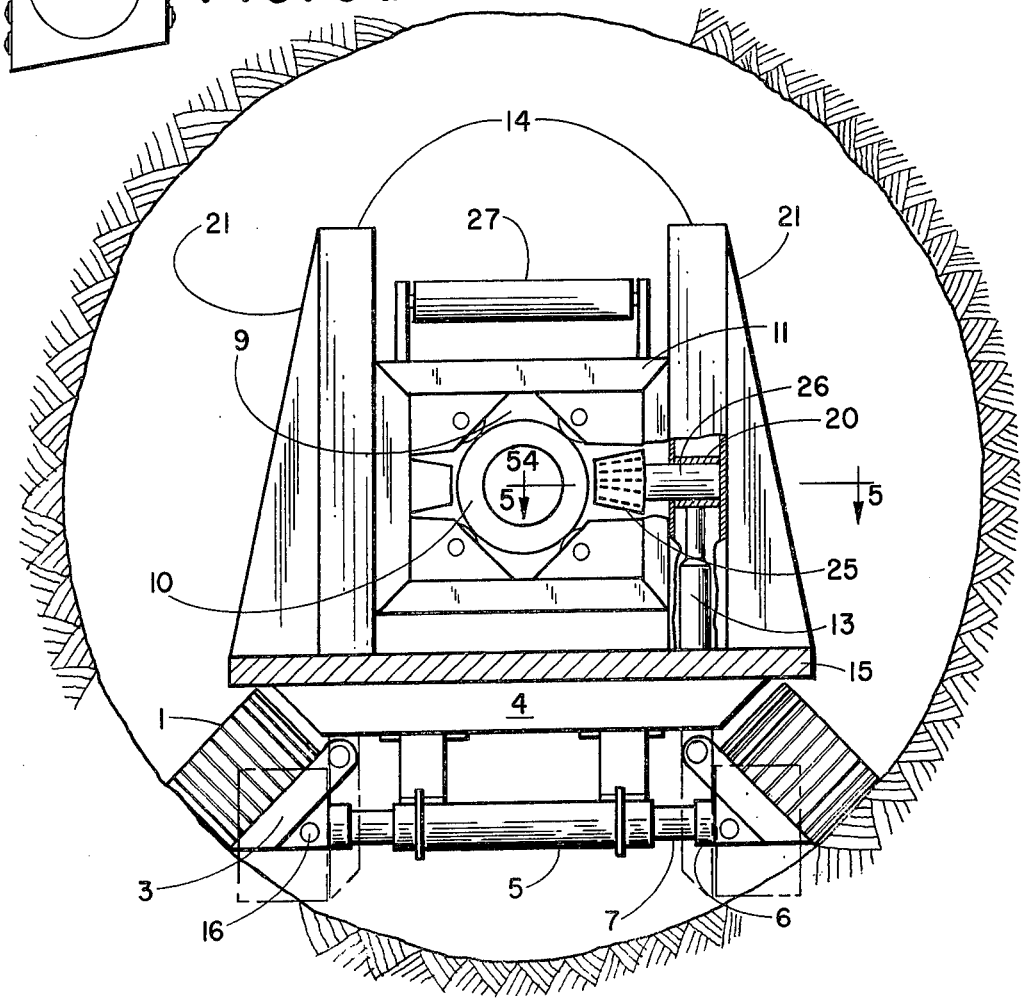
FIG. 4

SELF PROPELLED EXCAVATING VEHICLE

The invention described herein may be manufactured and used by or for the Government for governmental purposes without payment of any royalty thereon.

BACKGROUND OF THE INVENTION

1. Field of the Invention

The invention is in the field of excavating apparatus.

2. Description of the Prior Art

It is known in the art to elevate vehicular tracks to accommodate an auxiliary power means as demonstrated by W. R. Bertelsen, U.S. Pat. No. 3,095,938. M. B. Kurkpatrick, U.S. Pat. No. 2,864,600 teaches a method of employing radially adjustable wheels on a curved platform to guide his mining machine. The prior art does not show a method of primary propulsion on angularly adjustable crawler tracks.

An invention by E. C. Seward, U.S. Pat. No. 3,202,243, although arising out of an entirely different context, teaches two platforms moving relative to one another by means of a piston with both horizontal and vertical capabilities. W. Tiblin, U.S. Pat. No. 3,314,724 employs hydraulic rams to move a main shaft relative to the crawler tracks and H. H. Gardner, U.S. Pat. NO. 2,821,374 teaches a pivot actuated steering mechanism which permits vertical movement. Thepresent invention is capable of varying the horizontal, vertical and lateral attitudes of the shaft to fashion a tunnel, and this is new to the art.

W. Tinlin, U.S. Pat. No. 3,314,725 teaches a method of making a rotatable pneumatic drilling head to reciprocate horizontally and vertically within a rectangular frame by means of a plurality of screw jacks. The prior art does not teach a frame mounted movable bearing assembly.

James G. Patrick, U.S. Pat. No. 3,887,236 teaches a tension cutting method wherein undisturbed rock is broken from the inplace mass by a breaking force acting in a radial direction or one otherwise transverse to the direction of excavation dependent upon the cantilevered echelon cut. The prior art does not teach a tension cutting method without the utilization of a cantilevered echelon cut.

L. W. Anderson, U.S. Pat. No. 1,462,997 added to the art the use of rotating pick-up buckets with a central recovery hopper, but nowhere in the art is taught a continuous belt conveyor which rotates with the drilling head. The prior art does not teach a vehicle mounted, kerf cutting and tension wedge breaking drilling head as presented herein.

SUMMARY OF THE INVENTION

The vehicle has many desirable features improving the prior art. The crawler track assemblies support the vehicle and impart the required thrust to the tracks for propulsion on the tunnel floor or walls. The track assemblies are easily adjusted for any size tunnel within the vehicle's range. Each track is propelled by its own hydraulic motor and reduction gear mechanism.

Two large bearing assemblies support the shaft on which is affixed the drill head assembly. The bearing assemblies are affixed to the platform, and a pin connects a double-action hydraulic ram to the platform. This double-action hydraulic ram is attached to the base frame, and the ram will move the platform left or right of the tunnel centerline. Another double-action hydraulic ram affixed to the base frame causes rotation of the platform about the pin.

The drill head assembly is supported by and rotated with the shaft. The drill head assembly has four main groups: The pneumatic drills which are expansible within the range of the vehicle; the fluid actuated rock breakers; muck buckets which help gather the broken rock on the first conveyor; and the rotatable first conveyor which passes the tunnel muck back lead to the second conveyor. Except for the air systems required to drive the drills and to operate the pneumatic motor which turns the rotatable conveyor, the vehicle is hydraulically powered. All major controls for the operation of the vehicle are in the operators cab at the rear of the vehicle.

It is, accordingly, a primary objective of the invention to produce a vehicle which is highly efficient and extremely practical in performing tunnelling operations.

Another object is to provide a vehicle which is readily adaptable to use in short tunnels, adits and tunnels with variable rock formations.

It is a further object of this invention to provide a vehicle in which most of the tunnel face may be seen as the tunnelling is in progress.

A further object of the invention is to provide a vehicle which takes up less space in the section of tunnel where it is working, therefore, allowing more room for workmen to perform other essential functions such as setting support steel.

Another objective of this invention is to provide a vehicle which permits setting of support steel very close to the tunnel face being excavated.

Yet another objective of this invention is to provide a vehicle relatively adaptable for use in an unsupported tunnel.

It is an object of this invention to provide a vehicle which can easily correct vertical or horizontal alignment and which is crawler mounted so that there is no loss of time for the stroking cycles as in prior art tunnelling machines.

A further object is to provide a vehicle which will easily permit entry to the front for performing functions as consolidation grouting without removing the vehicle from the tunnel.

Still another object is to provide a vehicle which is readily accessible to the front for inspection of the head or replacement of parts.

It is an object of this invention to provide a vehicle which can be readily retracted through a lined or supported section of the tunnel by virtue of its collapsible frame adjusting feature.

It is a further object of the invention to provide a vehicle which can be reused economically on various sizes of tunnels, thereby eliminating the practice of expending costly machines at the conclusion of a single job. These and other objects will become apparent from the following description, wherein:

FIG. 4 is a view taken on line 4—4 of FIG. 2;

FIG. 5 is a partial horizontal sectional view on the line 5—5 of FIG. 4;

FIG. 6 is an enlarged view of a thrust bearing for the drive shaft;

Figure 3:
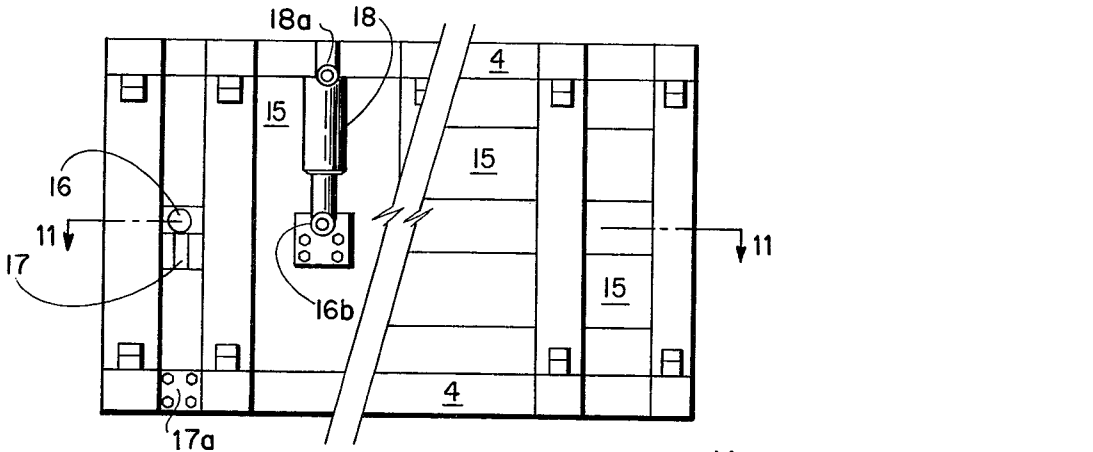
FIG. 3 is a view on lines 3—3 of FIG. 2 showing the extendable frame support.
Figure 7:
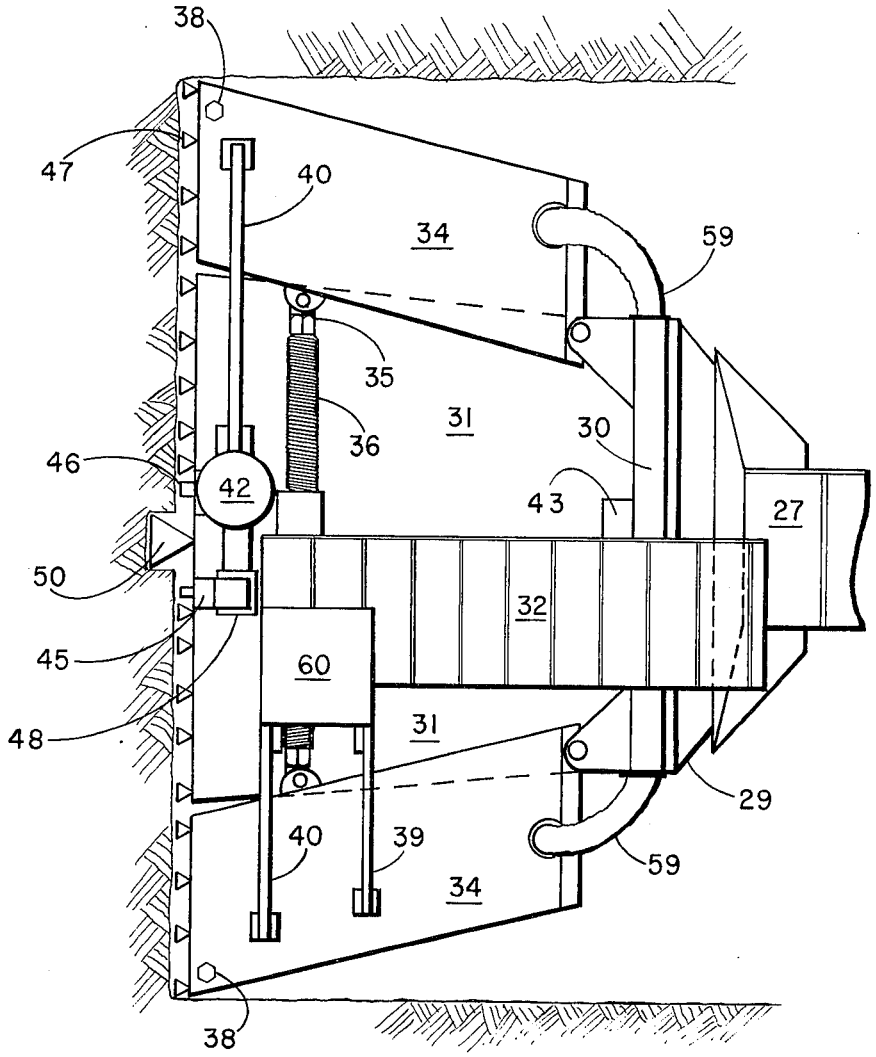
Figures 8, 9:
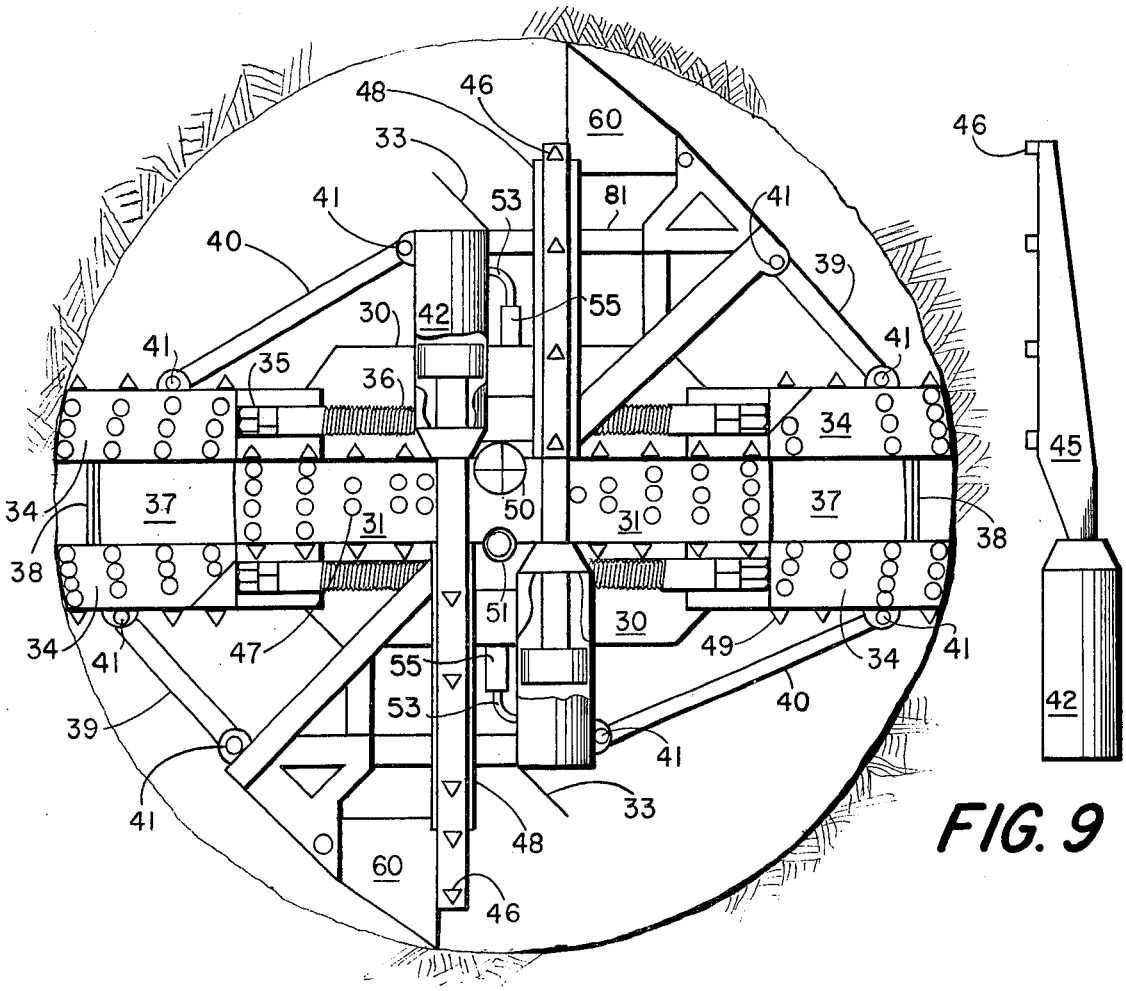
Figure 10:
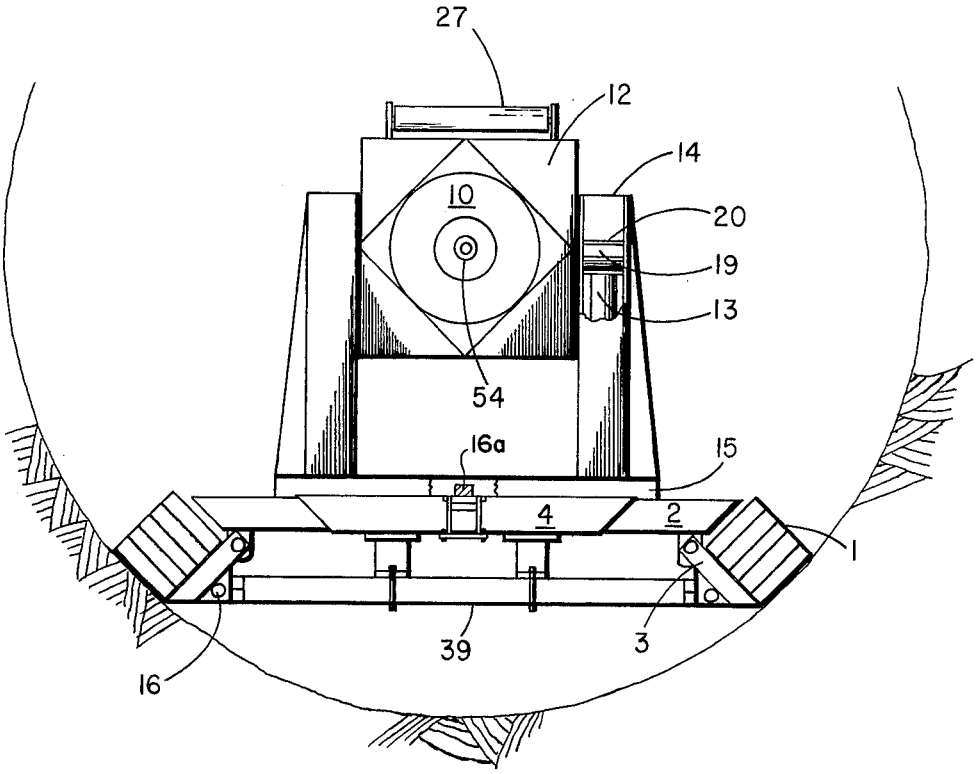
Figure 11:
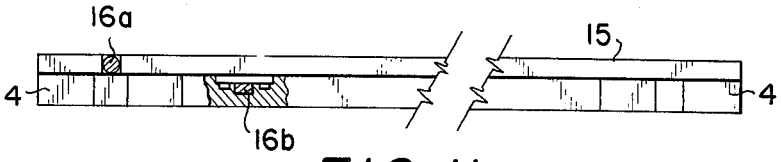

FIG. 6*a* is a view on the line 6*a*–6*b* of FIG. 6;
FIG. 7 is a plan view of the drill head assembly;
FIG. 8 is a front view of the drill head assembly;
FIG. 9 is an elevational view of a fluid actuated breaker assembly; and
FIG. 10 is a view on line 10—10 of FIG. 2.
FIG. 11 is a view on line 11—11 of FIG. 3.

DESCRIPTION OF THE PREFERRED EMBODIMENTS

Figure 1:
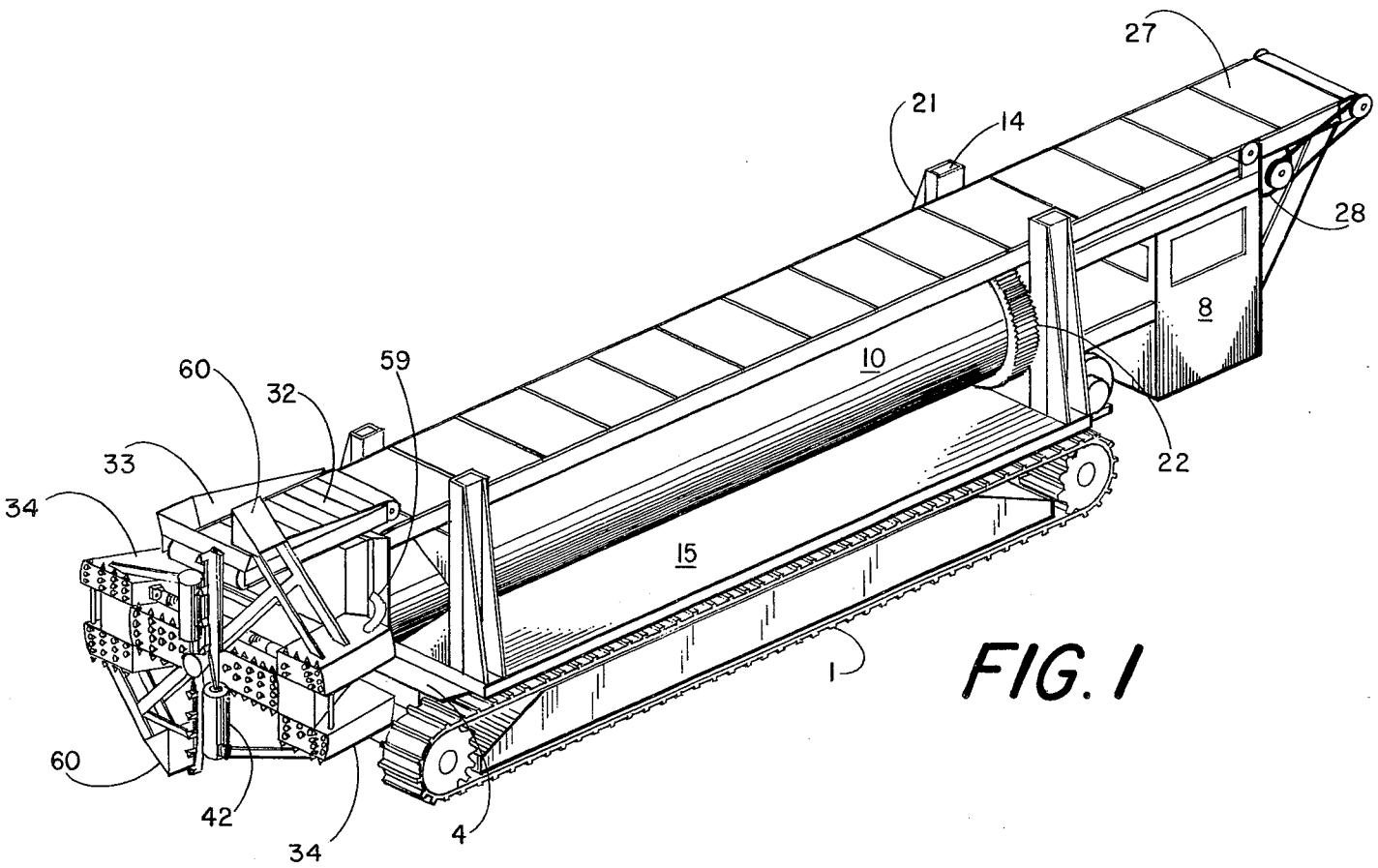
FIG. 1 is a perspective view of the self-propelled excavating vehicle.
Figure 2:
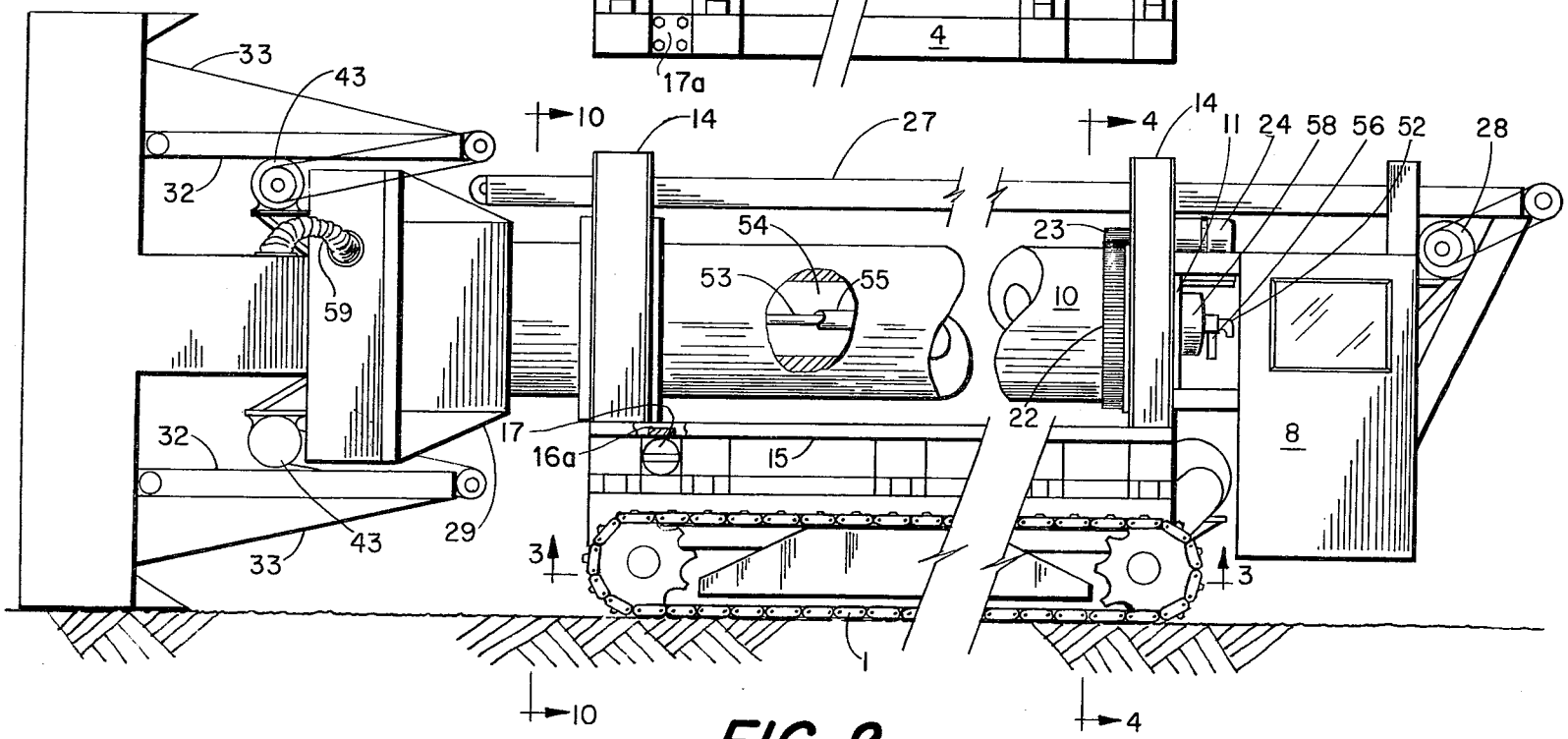
FIG. 2 is a side elevational view of the self-propelled excavating vehicle.

The crawler track assemblies are shown generally at 1 in FIGS. 1 and 2. They are used for supporting the vehicle and imparting the required forward and reverse thrust. They are each individually powered through reduction gear by a hydraulic motor (motor and reduction gears are not shown). The crawler track assemblies 1 are attached to the frame extension 2 by a suitable hinge 3. The frame extension 2 (see FIG. 10) is capable of telescoping outwardly from the base frame 4. With the adjustment of the horizontal brace 5 the crawler track assemblies 1 can be angled from vertical to at least 45° . The adjustment lugs 6 are affixed to independent and threaded shafts 7 which are mated into the horizontal brace 5 to allow the angling of the crawler track assemblies. There are variously sized horizontal braces which can be adopted for use with the crawler track assemblies. At least two horizontal braces 5 are affixed to the base frame 4. The hydraulic motors for the tracks 1 are controlled from the operator's cab 8. The operator's cab 8 will house all operating controls (not shown) and will, in addition, have an accurate level bubble (not shown) to check against the vertical attitude of the shaft 10. This is possible since the operator's cab 8 is firmly affixed to the rear bearing assembly 11 (FIG. 2) and will respond to changes in direction of the main shaft 10.

The shaft 10 is supported to the rear bearing assembly 11 and the front bearing assembly 12. These bearing assemblies are affixed to double-action hydraulic rams 13 braced in slide brackets 14. The brackets 14 are firmly affixed to the platform 15. The platform 15 pivotally rests upon the base frame 4. The platform 15 is capable of left and right movement around pins 16*a* and 16*b*in FIG. 3. The pin with one end firmly affixed to the platform 15 cooperates with a bearing (not shown) and is moved by the double-action hydraulic ram 18 which is attached to the frame 4 by pins 18*a*. The ram 18 is used to regulate the position of the pin 16 16*b* with respect to left or right of the tunnel centerline. In addition, affixed to the underside of platform 15 by pin 17*a* and affixed to the base frame 4 by pin 16*a* is a double-action hydraulic ram 17 which causes rotation about the pin 16*a* of the platform 15 in relationship to the base frame 4. The front and rear bearing assemblies 11 and 12, respectively, are supported by a horizontal shaft 19 which rests in a bearing 20. The shaft can be raised or lowered by a double-action hydraulic ram 13 which is housed inside a slide 14 that is firmly affixed inside slide brackets 21, as in FIG. 4, which are firmly affixed to the platform 15.

In FIG. 4, resting in the rear bearing assembly 11 and FIG. 10 the front bearing assembly 12 is the shaft 10. The shaft 10 is supported in the front bearing assembly 12 by four bearings which are bolted through the bearing assembly 12. The rear bearing assembly 11 supports the rear end of the shaft 10 and enters a milled section (not shown) at the end of the shaft 10. The shaft 10 is supported in the rear bearing assembly by four bearings (not shown). The front bearing assembly 12 and the rear bearings assembly 11 will keep the same orientation of the shaft 10 regardless of the height of one bearing assembly to the other. The shaft 10 has a bull gear 22 firmly affixed to it and is rotated by a pinion gear 23 which passes through the bearing assembly 11 to a reduction gear and hydraulic motor generally shown at 24. The hydraulic motor 24 has the ability to go in a forward or reverse direction and is controlled at the operator's cab 8. The rear bearings assembly 11 houses the thrust bearings 25 (one of which is shown in FIG. 4) which are mounted on the thrust bearing shaft 26. The thrust bearings 25 work directly against the rear end of the milled section of the shaft 10. Reverse thrust is possible by the action of the rearward end of the thrust bearings 25 acting against the butt plate 9 which is bolted onto the rearward end of the shaft 10.

The main conveyor 27 is firmly affixed to the bearing assemblies 11 and 12. A hydraulic motor 28 drives the conveyor 27 and is controlled from the operator's cab 8. The hydraulic pumps (not shown) for all hydraulic motors are situated near the end of the platform 15 and are driven by electric motors. Ample space for additional motors is available under the base frame 4. Not shown, but included in the hydraulic system, are storage tanks for the hydraulic oil and coolers. Ample space exists above the platform 15 for these units. The drill head assembly is generally shown at FIGS. 7 and 8. The assembly mount 29 is firmly affixed to the shaft 10 onto which is firmly affixed the main air chamber 30 to which is firmly affixed the inner drill assembly 31. The rotatably mounted conveyor 32 is affixed to the front of the drill head assembly. The muck bucket 60 scoops fallen rock and carries it until it is dumped onto conveyor 32. The muck chute 33 is mounted on each side of conveyor 32 to prevent the muck from falling over the sides of the conveyor 32. A hinge mechanism affixes the main air chamber 30 to the back end of the outer drill assemblies 34 (see FIG. 7). The turning of the adjustment lugs 35, FIGS. 7 and 8, fixes the inward and outward position of the front end of the outer drill assemblies 34. In addition to the bracing afforded by the threaded shaft 36, there are installed and firmly affixed to the inner drill assemblies 31 spacer braces 37 which give support to the outer drill assemblies 34. Further bracing is accomplished by tying together the upper and lower sections of the outer drill assemblies 34 by bolts 38. Other braces 39 and 40 are also installed and can be eliminated by removing pins 41 (see FIG. 8). Different tunnel sizes require a change in location of the conveyor 32 which is movable inwardly or outwardly. The conveyor 32 is affixed to the fluid actuated breaker 42 (FIG. 8) at the front and the air chamber 30 at the rear. The conveyor 32 rotates with the drill head. When the conveyor 32 is over the conveyor 27, a spring loaded trip lever (not shown) on the revolving drill head strikes the stationary conveyor 27 and causes air to flow to the air motor 43 (FIG. 2) which activates the conveyor 32 and unloads onto the chute 33. After the conveyor 32 passes the chute 33, the spring loaded trip lever returns to the closed position and the conveyor 32 stops.

Firmly affixed to the inner drill assemblies 31 are two fluid actuated breakers 42 supported by brace 81 which point in opposite directions (see FIG. 8). A breaker arm 45 extends from each breaker 42, and affixed on these arms are metal lugs 46 which enter the kerfs cut by the pneumatic drills 47, whereby the rock is broken by the striking of the lugs 46 against the ridge of rock between the kerfs. The direction of the smashing blows is outward, and the arm 45 is braced by a slide 48 supported by brace 81. Bolted on the leading and trailing sides of the drill assemblies are wedge-like members 49 which also enter the kerfs and dislodge any rock fragments which may be in the path of the drills 47.

A pilot drill 50 near the center of the tunnel head is off and centered by the diameter of the drill bit and cuts a hole twice the diameter of the bit as the machine revolves. Just opposite this bit is a conical rolling rock breaker 51 which breaks a thin web or ridge of rock which remains outside of the center hole cut by the drill 50 and inside the kerf cut by the first row of drills 47. The hydraulic oil for the fluid actuated breakers 42 is supplied from the main hydraulic pumps (not shown) through the operator's control panel (not shown) through the operator's control panel (not shown) to the intake swivel 52 at the rear of shaft 10 (see FIG. 2). The hydraulic oil for the breakers 42 travels through line 53 inside the air supply channel 54 of the main shaft 10 to the fluid actuated breakers 42 and from there back over the outside of line 53 through line 55 to the swivel 56 and then to the oil reservoir tanks (not shown).

The path of air travel to the drills follows the air line 55 of the air swivel 58, then through the air supply channel 54 of the main shaft 10. The outlet of the air supply channel 54 is attached so that air is supplied to the main air chamber 30 (see FIG. 7) and the through flexible hoses 59 to the outer drill assemblies 34. To control dust in the tunnel, water will be injected into the air line 55 and emerge at the drills 47 and 50.

The drills 47 and 50 are down-the-hole pneumatic hammers, and they will be constructed so as to be threaded on the outside near the top end for a suitable distance, and they will in turn be screwed into the drill assemblies. The threading of the outside of the drills will permit fine adjustments for depth of penetration as some drills will have to be farther forward than others. A suitable device is provided to prevent the drill from unscrewing during drilling. A metal plug will be inserted into the drill holes which are not being used.

CUTTER OPERATION

The machine approaches the wall to be drilled by activating the tracks 1. When the drill head contacts the wall, the pilot drill 50 is activated and begins drilling. As the wall is penetrated the pneumatic drills 47 contact the wall and are activated. The bull gear 23 begins to rotate the main shaft 10 and, consequently, the drill head. Leading and trailing members 49 enter the kerfs cut by the drills and dislodge the rock fragments therein. As the drill head continues to rotate, the kerfs become deep enough for penetration by the lugs 46 of the breaker bars 45. At this point the breakers 42 are actuated forcing the breaker arms 45 outward which results in the breaking of the rocks between the kerfs. The conical rock breaker 51 is also actuated and breaks the ridge of rock between the innermost drills and the pilot drill 50. As the drill head rotates, the muck buckets scoops fallen rock. When the drill head rotates to a point where a muck bucket is in the top position, the rock in the bucket begins to fall into the chute 33 and onto the conveyor 32. When the conveyor 32 is located over the main conveyor 27, the conveyor 32 is activated and unloads the chute.

Although a particular embodiment and form of this invention has been illustrated, it is obvious to those skilled in the art that modifications may be made without departing from the scope and spirit of the foregoing disclosure.

I claim:

1. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said extension means, when activated, causing rotation of said tractive means about said hinge means;

c. a movable platform pivotally supported by said base frame;

d. means for pivotally rotating said base frame with respect to said movable platform;

e. bearing assembly means fixedly mounted on said movable platform;

f. a rotatable shaft carried by said bearing assembly means and supporting a drill head assembly at one end thereof;

g. first conveyor belt means supported by said drill head assembly;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

2. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said tractive means pivoting vertically outward about said hinge means and held in adjustment by a horizontal bracing means whereby said tractive means when in an angular position are in contact with the tunnel floor or walls and are the primary locomotion means for the vehicle;

c. a movable platform pivotally supported by said base frame;

d. means for pivotally rotating said base with respect to said movable platform;

e. bearing assembly means fixedly mounted on said movable platform;

f. a rotatable shaft carried by said bearing assembly at one end thereof;

g. first conveyor belt means supported by said drill head assembly;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

3. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said extension means, when activated, causing rotation of said tractive means about said hinge means;

c. a movable platform pivotally supported by said base frame;

d. the combination of a pin attached to said movable platform and to a force producing means affixed to said base frame with said pin cooperating with an antifrication means and another force producing means whereby said movable platform is made to pivot about a laterally movable horizontal plane relative to said base frame and provides the steering mechanism for said platform;

e. bearing assembly means fixedly mounted on said movable platform;

f. a rotatable shaft carried by said bearing assembly means and supporting a drill head assembly at one end thereof;

g. first conveyor belt means supported by said drill head assembly;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

4. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said extension means, when activated, causing rotation of said tractive means about said hinge means;

c. a movable platform Pivotally supported by said base frame;

d. means for pivotally rotating said base frame with respect to said movable platform;

e. the combination of a rotatable shaft carried by selectively actuated frame mounted bearings supported on elevative means which are fixedly attached upon said movable platform whereby variable vertical relationships in parallel planes of one frame mounted bearing to the other in cooperation with said movable platform enables said shaft to assume multiple vectorial attitudes with respect to a plane representing said base frame;

f. a drill head assembly supported by said rotatable shaft;

g. first conveyor belt means supported by said drill head assembly;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

5. An excavating vehicle as in claim 4 wherein said frame mounted bearings comprise antifriction means affixed within a geometric brace which is supported by double-acting telescopic fluid activated rams housed within suitable slides firmly affixed to said platform.

6. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said extension means, when activated, causing rotation of said tractive means about said hinge means;

c. a movable platform pivotally supported by said base frame;

d. means for pivotally rotating said base frame with respect to said movable platform;

e. bearing assembly means fixedly mounted on said movable platform;

f. a rotatable shaft having a milled section carried by said bearing assembly means and supporting a drill head assembly, said shaft having a butt plate and a bull gear firmly affixed to one end thereof for cooperation with a pinion gear which passes through said bearing assembly means to a reduction gear cooperating with reversible drive means, said bearing assembly means housing thrust bearings mounted on said shaft for transferring thrust from said tractive means to said shaft, whereby one end of said thrust bearings contact the rear end of said milled section of said rotatable shaft for forward thrust, an opposite end of said thrust bearings contacts said butt plate for reversible thrust on said shaft;

g. first conveyor belt means supported by said drill head assembly means;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

7. A self propelled excavating vehicle comprising:

a. a base frame having a tractive means, the lower portion of said tractive means connected to said base frame by a hinge means;

b. extension means fixedly secured to said base frame and hingedly affixed to the upper portion of the tractive means, said extension means, when activated, causing rotation of said tractive means above said hinge means;

c. a movable platform pivotally supported by said base frame;

d. means for pivotally rotating said base frame with respect to said movable platform;

e. bearing assembly means fixedly mounted on said movable platform;

f. a rotatable shaft caried by said bearing assembly means and supporting a drill head assembly at one end thereof and drive means for said shaft at an opposite end;

g. a first conveyor belt suitable for gathering excavating material and peripherally mounted to and rotatable with said drill head assembly, said first conveyor cooperating with a stationary collection device affixed to said rotatable shaft, and fluid actuating means fixedly mounted on said drill head assembly whereby at a desired location of said first conveyor said fluid actuating means is activated to power said first conveyor causing said conveyor to unload excavated material into said collection device;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

8. A self propelled excavating vehicle comprising:

a. a base frame having a tractive means, the lower portion of said tractive means connected to said base frame by a hinge means;

b. laterally adjustable base frame extension means fixedly secured to said base frame and hingedly affixed to the upper portion of the tractive means, said tractive means pivoting vertically outward relative to said adjustable base extension means and which are held in adjustment by horizontal bracing means whereby said tractive means when in an angular position are operative while in contact with the tunnel floor or walls and are the primary locomotion means for the vehicle;

c. a pin attached to a movable platform supported by said base frame and to a force producing means affixed to said base frame, said pin is the pivotal point cooperating with an antifriction means and another force producing means affixed to said base frame and said pin whereby said movable platform is made to pivot about a laterally movable horizontal plane relative to said base frame and provides the steering mechanism for said platform;

d. a rotatable shaft carried by selectively actuated frame mounted bearings supported on elevative means which are fixedly attached upon said movable platform whereby variable vertical relationships in parallel planes of one frame mounted bearing to the other in cooperation with said movable platform enables said shaft to assume multiple vectorial attitudes with respect to a plane representing said base frame;

e. said rotatable shaft having a milled section carried by said bearing assembly means and supporting a drill head assembly at an end thereof and having a butt plate and bull gear firmly affixed thereto for cooperation with a pinion gear which passes through said bearing assembly means to a reduction gear and reversible drive means wherein said bearing assembly means house thrust bearings which are mounted on said shaft and transfer thrust from the tractive means to the shaft whereby one end of said thrust bearings contact the rear end of said milled section of said rotatable shaft for forward thrust, an opposite end of said thrust bearings contacts said butt plate for reversible thrust on said shaft;

f. rotatable shaft carried by said bearing assembly means and supporting a drill head assembly at one end thereof;

g. a first conveyor belt suitable for gathering excavated material and peripherally mounted to and rotatable with said drill head assembly, said first conveyor cooperating with a stationary collection device affixed to said rotatable shaft, a suitable trip lever carried on said drill head assembly, and fluid actuating means fixedly mounted on said drill head assembly whereby at a desired location of said first conveyor, said fluid actuating means is activated to power said first conveyor causing said conveyor to unload excavated material into said collection device;

h. second conveyor belt means secured to said bearing assembly means for cooperating action with said first conveyor means; and i. an operator's cab and operating control means attached to the most rearward of said bearing assembly means whereby said cab maintains the same vertical attitude as said most rearward bearing assembly means while operating said vehicle.

9. A self propelled excavating vehicle as in claim 8 where said bearing assembly means comprise antifriction means affixed within a geometric brace which is supported by double-acting telescopic fluid activated rams housed within suitable slides firmly affixed to said movable platform.

* * * * *